US010448760B2

(12) United States Patent
Gresset

(10) Patent No.: US 10,448,760 B2
(45) Date of Patent: Oct. 22, 2019

(54) SECURE ARTICLE PRESENTATION DEVICE

(71) Applicant: SAAA SAS—SYSTEMES d'AUTOMATISMES D'ALARMES AUTOMATIQUES, Gallardon (FR)

(72) Inventor: Eric Gresset, Jouy (FR)

(73) Assignee: SAAA SAS—SYSTEMS D—AUTOMAISMES D'ALARMES AUTOMATIQUES, Gallardon (FR)

( * ) Notice: Subject to any disclaimer, the term of this patent is extended or adjusted under 35 U.S.C. 154(b) by 0 days.

(21) Appl. No.: 15/348,174

(22) Filed: Nov. 10, 2016

(65) Prior Publication Data

US 2017/0135501 A1 May 18, 2017

(30) Foreign Application Priority Data

Nov. 13, 2015 (FR) ..... 15 60882

(51) Int. Cl.
*A47F 7/024* (2006.01)
*A47F 7/02* (2006.01)

(52) U.S. Cl.
CPC ..... *A47F 7/024* (2013.01); *A47F 7/022* (2013.01)

(58) Field of Classification Search
CPC .... A47F 7/024; A47F 7/22; A47F 7/02; A47F 7/142; A47F 7/143; A47F 7/00; A47F 7/0028
USPC ..... 248/114, 551; 340/568.2, 568.1, 568.3, 340/568.8, 541, 686; 70/14, 52, 58, 57.1, 70/62
See application file for complete search history.

(56) References Cited

U.S. PATENT DOCUMENTS

| | | | | |
|---|---|---|---|---|
| 5,140,836 | A | 8/1992 | Hogan et al. | |
| 5,275,027 | A | 1/1994 | Eklof et al. | |
| 6,312,052 | B1 * | 11/2001 | Elio | B60N 2/442 248/430 |
| 6,831,560 | B2 * | 12/2004 | Gresset | A47F 7/024 340/568.2 |
| 9,529,332 | B2 * | 12/2016 | Perrinjaquet | A47F 7/022 |
| 2009/0108168 | A1 * | 4/2009 | O'Brien | A61M 16/1075 248/551 |

FOREIGN PATENT DOCUMENTS

| | | |
|---|---|---|
| DE | 102 54 776 | 6/2004 |
| GB | 2 363 422 | 12/2001 |
| JP | 2009 202877 | 9/2009 |
| WO | WO 02/39856 | 5/2002 |
| WO | WO 2015/051840 A1 | 4/2015 |

* cited by examiner

*Primary Examiner* — Nkeisha Smith
(74) *Attorney, Agent, or Firm* — Fay Sharpe LLP; James E. Scarbrough

(57) ABSTRACT

An article presentation device (10) comprising a base (20) having at least one slot (22), at least one support (30) configured to receive at least one article and to be inserted in and extracted from the slot (22), and at least one catch (40) that is movable between a locked position in which the catch (40) is suitable for co-operating with the support (30) in order to retain it in the slot (22), and an unlocked position in which the catch (40) enables the support (30) to be extracted from the slot (22), each catch (40) being associated with a single slot (22) and being actuated by a distinct drive mechanism (50). The drive mechanism (50) is configured to drive the catch (40) in turning.

13 Claims, 3 Drawing Sheets

SECURE ARTICLE PRESENTATION DEVICE

CLAIM OF PRIORITY

This application claims priority to French Patent Application FR 1560882 filed on Nov. 13, 2015, the entirety of which is incorporated by reference herein.

FIELD OF THE INVENTION

The present description relates to presenting articles, and more particularly to a device for presenting articles securely. Such a device may be used in particular for secure presentation of watches in a sales area.

TECHNOLOGICAL BACKGROUND

In shops and sales areas, it is possible to improve sales by putting certain products directly in contact with the consumer. Thus, with or without oversight by a salesperson, the consumer can touch or take hold of the product in order to assess it better. Nevertheless, for articles of value, doing away with protective showcases makes it necessary to use alternative secure presentation devices.

For watches, and more particularly wristwatches, various systems already exist, such as that described in patent application DE 102 54 776 A1. That document discloses a presentation device having a first plate with cutouts leaving tongues around which watch straps are engaged. A second plate, having windows made therein that are smaller than the cutouts, is superposed on the first plate in such a manner that the windows leave the watches visible while partially covering the cutouts. Thus, when the plates are in the superposed position, it is not possible to extract the watches.

More sophisticated systems also exist, but they are difficult to use. There are also devices that are not very attractive in appearance or that lock or release all of the watches at the same time, which can be damaging in terms of article security.

There thus exists a need for a novel type of article presentation device.

SUMMARY OF THE INVENTION

To this end, the present description relates to an article presentation device comprising a base having at least one slot, at least one support configured to receive at least one article and to be inserted in and extracted from the slot, and at least one catch that is movable between a locked position in which the catch is suitable for co-operating with the support in order to retain it in the slot, and an unlocked position in which the catch enables the support to be extracted from the slot, each catch being associated with a single slot and being actuated by a distinct drive mechanism.

In such a device, a slot and the catch associated with the slot form a slot-and-catch system. The article presentation device may have a plurality of slot-and-catch systems of the above-defined type. For example, these slot-and-catch systems are organized in rows. Below, unless specified to the contrary, any reference made to "each slot-and-catch system" covers the situation in which the device has only one slot-and-catch system or a plurality of slot-and-catch systems.

Such a presentation device is simple in design and can be made particularly attractive. In addition, it is simple to use. Finally it is optimized with respect to security: because the respective catch in each slot-and-catch assembly is associated with the respective slot of the corresponding slot-and-catch assembly and is actuated by a distinct drive mechanism, in particular a mechanism that is specific to each slot-and-catch assembly, moving one catch into its unlocked position has no influence on the catch of any other slot-and-catch assembly, if there is more than one. Consequently, a support carrying an article can be extracted easily without that affecting security for articles carried by other supports, if there are any.

In certain embodiments, the drive mechanism is configured to drive the catch in turning, in particular around the slot. Thus, the space that needs to be provided for the various positions of the catch is limited, thereby enabling the presentation device to be made compact, in particular when a plurality of slot-and-catch systems are provided beside one another.

In certain embodiments, the drive mechanism comprises a motor. Thus, the drive mechanism may be actuated under electrical control, possibly remote control, without requiring direct access to the drive mechanism.

In certain embodiments, the drive mechanism comprises a cam configured to drive the catch from the locked position to the unlocked position and to leave the catch free to move from the unlocked position to the locked position. Interaction between the cam and the catch is thus limited, thereby increasing the reliability of the device.

For example, the cam may be configured to co-operate with the catch over one fraction of its travel, while in the remaining fraction of its travel, the cam moves without co-operating with the catch.

In certain embodiments, the catch is generally in the form of a plate that extends substantially parallel to the slot. For example, this plate may be made as a single piece. In the context of the present description, two straight lines (or planes as the case may be) are said to be "substantially parallel" when those two lines (or planes as the case may be) form between them an angle of no more than 45°, and preferably an angle of less than 20°, or indeed an angle of 0°. By means of these provisions, the space occupied by the catch is minimized. Furthermore, stating that the catch is "substantially parallel to the slot" means that it is substantially parallel to the plane defined by the edges of the slot.

In certain embodiments, the slot includes at least one window and a portion of the catch crosses said window. The portion of the catch crossing the window may serve to fasten the catch to the slot.

In certain embodiments, the catch in the locked position is configured to enable the support to be inserted in the slot. Alternatively or in addition, the support may be configured to enable it to be inserted into the slot while the catch is in the locked position. The device thus enables the support to be locked in the slot automatically and easily.

Insertion of the support in the locking position may take place by snap-fitting. Snap-fitting is a movement made possible by a mechanism designed to allow such movement in one direction and to prevent the movement in the opposite direction. In certain embodiments, the snap-fitting may be achieved by means of a spring, in particular of the spring-blade type.

In certain embodiments, the catch includes return means configured to urge the catch from the unlocked position to the locked position. This is particularly advantageous for providing security for the support in the event of a failure of the drive mechanism or in order to limit co-operation between the cam and the catch, where appropriate, so as to avoid premature wear of the catch. The return means may be suitable for co-operating with the slot. In particular, the return means may comprise a spring, in particular of the spring-blade type. In an embodiment, the catch includes a return element configured both to return the catch from the unlocked position to the locked position and also to snap-fit the support in the slot. These two functions performed by the return element enable the structure of the catch to be optimized and simplified.

In certain embodiments, the drive mechanism includes detector means for detecting an unlocked position of the catch. The drive mechanism may comprise timer means configured to hold the catch in an unlocked position for a predetermined duration starting from the moment that the detector means detect that the catch is in the unlocked position.

The detector means and/or the timer means serve to facilitate extracting the support from the slot, respectively by indicating and/or prolonging the duration during which the catch is in the unlocked position.

In certain embodiments, the support includes a locking portion configured to co-operate with the catch when the catch is in the locked position. The locking portions of the support and of the catch may be respectively male or female.

In certain embodiments, the drive mechanism is configured to receive authorization to unlock, and on receiving said authorization, to drive the catch from the locked position to the unlocked position. Authorization to unlock may be transmitted by a wired or wireless signal, in particular by infrared and/or by means of a remote control.

In certain embodiments, the support is configured to receive a watch, in particular a wristwatch.

BRIEF DESCRIPTION OF THE DRAWINGS

The invention and its advantages can be better understood on reading the following detailed description of embodiments of the invention given as non-limiting examples. The description refers to the accompanying drawings, in which.

DETAILED DESCRIPTION OF THE INVENTION

An embodiment of an article presentation device is described below in detail with reference to FIGS. 1 to 6.

Figure 1:
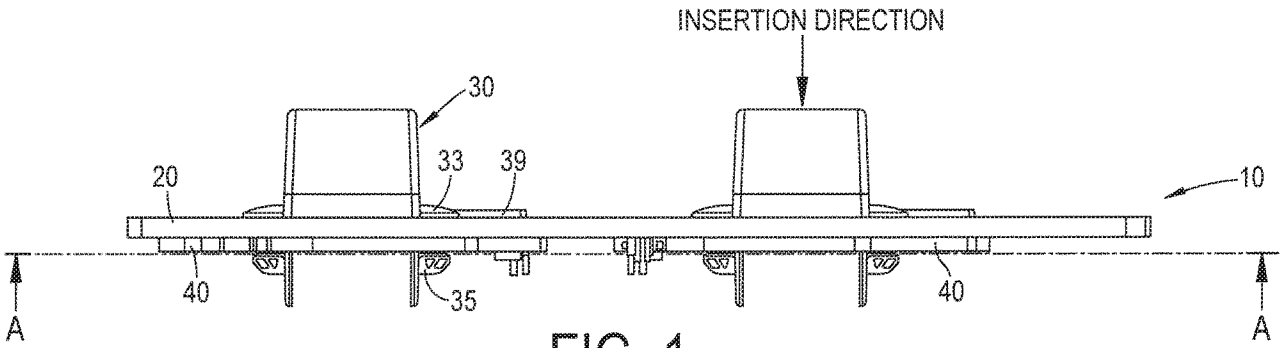
FIG. 1 is a side view of an embodiment of an article presentation device.

FIG. 1 is a side view of an article presentation device 10 (referred to below as the "device 10"). The device 10 has a base 20 with at least one slot 22 (see FIG. 4), at least one support 30 configured to receive at least one article and to be inserted in and extracted from the slot 22, and at least one catch 40. The catch 40 is movable between a locked position in which the catch 40 is suitable for co-operating with the support 30 in order to retain it in the slot 22, and an unlocked position in which the catch 40 allows the support 30 to be extracted from the slot 22.

In the present embodiment, the base 20 is generally in the form of a plate. The base 20 has a plurality of slots 22, with only two being shown in FIG. 1. Other shapes may be given to the base 20, in particular shapes that are quasi-plane, or shapes that are piecewise plane.

In the present embodiment, the device 10 has a plurality of catches 40, with only two of them being shown in FIG. 1.

Thus, the device 10 has a plurality of slot-and-catch systems, each slot-and-catch system itself comprising a slot 22 and a catch 40. Below, only one of these slot-and-catch systems is described. As mentioned above, each catch 40 is associated with a single slot 22.

The catch 40 is arranged on a rear surface of the base 20. In the present description, the front-rear direction corresponds to the direction in which articles are presented, the front being on the same side as the consumer. Thus, the catch 40 is arranged on the side of the base 20 that is not normally accessible to consumers.

The support 30, which is shown in part only in FIG. 1, has a locking portion that is configured to co-operate with the catch 40 when the catch 40 is in the locked position. Specifically, the support 30 has a front collar 33 and a rear collar 35 that are spaced apart from each other. Engaging the catch 40 in the space that exists between the front collar 33 and the rear collar 35 enables the support 30 to be held in the slot 22. These collars may be continuous, as in the example shown, or they may be discontinuous.

In addition, the support 30 has a zone 39 for positioning an informative marking, such as the price or the reference of the product carried by the support.

Figure 3:
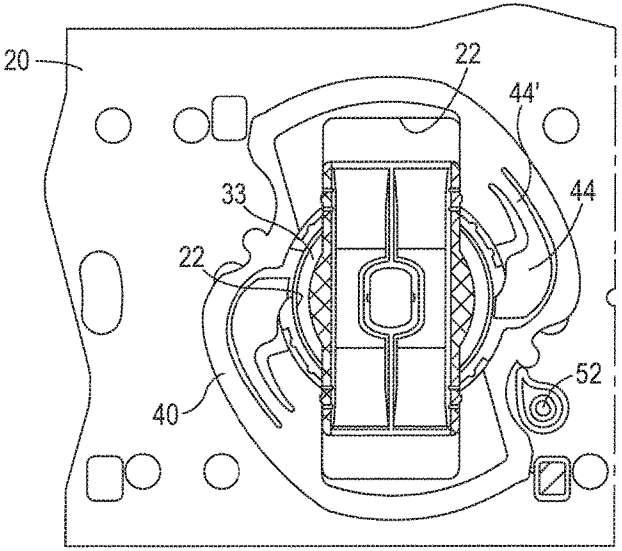
FIG. 3 is a fragmentary section view on plane A-A of FIG. 1, with the catch shown in the unlocked position.
Figure 2:
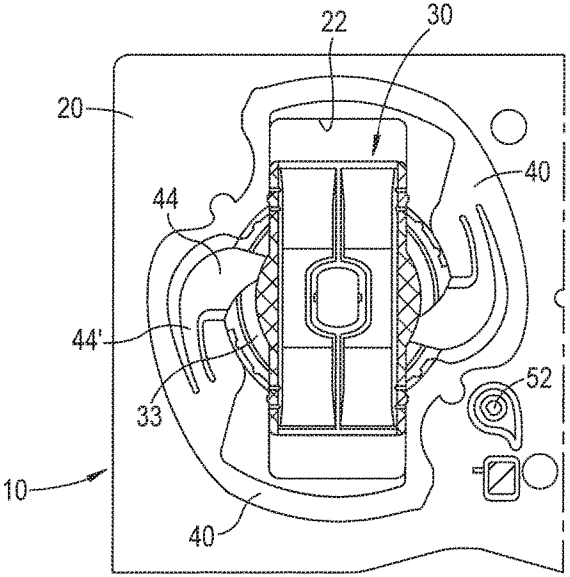
FIG. 2 is a fragmentary section view on plane A-A of FIG. 1, with the catch shown in the locked position.

Furthermore, as can be seen in FIGS. 2 and 3, which are described below, the shape of the support 30 and the shape of the slot 22 are designed so that when the support 30 is inserted in the slot 22, turning of the support 30 relative to the slot 22 is prevented. In particular, the shape of the slot 22 and the corresponding shape of the support 30 (which shapes are elongate in this example) prevent the support 30 from turning in the plane of the base 20.

FIG. 2 is a fragmentary section view on plane A-A of FIG. 1, showing the situation in which the catch 40 is in the locked position. The catch 40 includes at least one blade 44, there being two blades 44 in this example, which blades are described in greater detail below. In the locked position, the blades 44 of the catch 40 obstruct the slot 22 in part, becoming engaged between the two collars 33 and 35 of the support 30, thereby retaining the support 30. Thus, it is the blade(s) 44 of the catch that provide(s) the locking function by co-operating with the locking portion of the support 30. As shown in FIG. 2, the catch 40, and more particularly the blades 44, engage in the support 30 in transverse or radial manner, i.e. perpendicularly to the above-defined front-rear direction.

FIG. 3 is a fragmentary section view on plane A-A of FIG. 1, showing the situation in which the catch 40 is in the unlocked position. In this position, the blades 44 are set back from their locked positions. In particular, the blades 44 no longer engage in the locking portion of the support 30. As can be seen in FIG. 3, there is then nothing to prevent the support 30 from being extracted from the slot 22.

The catch 40 is caused to pass from the locked position shown in FIG. 2 to the unlocked position shown in FIG. 3 by turning the catch 40, in particular by turning the catch 40 around the slot 22. Specifically, the catch 40 is mounted to turn about an axis of the slot, in particular an axis that is substantially perpendicular to the plane of the slot. In this example, the catch 40 is turned in a plane that is substantially parallel to the plane of the slot 22. In FIGS. 2 and 3, the catch 40 turns counterclockwise in order to go from the locked position to the unlocked position.

In this embodiment, the catch 40 is turned in particular by means of a drive mechanism 50 (FIG. 5) that includes a cam 52, which can be seen in FIG. 3. The drive mechanism is described in greater detail below.

Figure 4:
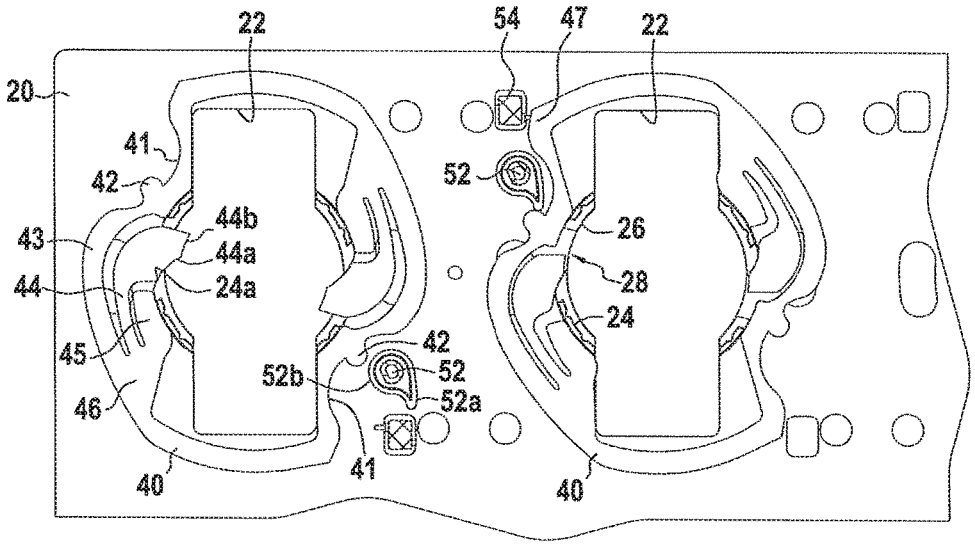
FIG. 4 is a rear view of the article presentation device.

The shape of the catch 40 is described in greater detail with reference to FIG. 4, which does not show the support 30. In FIG. 4, the catch 40 in the left-hand slot is shown in the locked position, while the catch 40 in the right-hand slot is shown in the unlocked position.

The catch 40 has a central cutout that, with the exception of the portions that perform locking (in this example the blades 44), is of a shape corresponding to the shape of the slot 22 regardless of whether the catch 40 is in its locked position or its unlocked position. Thus, as can be seen for the two positions shown in FIG. 4, the central cutout in the catch 40 allows a support 30 to be received in the slot.

The catch 40 comprises an outer frame 43, at least one blade 44, and an inner frame 45. In this example, the outer frame 43, the blade 44, and the inner frame 45 are joined together at their proximal ends, at a portion 46.

The outer frame 43 defines the outside shape of the catch 40 and ensures it holds together as a single part. The outer frame 43 serves to hold and center the catch 40 relative to the slot 22, in particular by co-operating with protuberances 26 at the periphery of the slot 22.

The inner frame 45 defines the inside shape of the catch 40 where it differs from the shape defined by the outer frame 43. The inner frame 45 serves to hold and center the catch 40 relative to the slot 22, in particular by co-operating with protuberances 24 at the periphery of the slot 22.

The protuberances 24 and 26 are spaced apart from one another so as to form a window. A portion of the catch 40, in this example the distal end of the blade 44, passes through said window.

The blade 44 is situated between the outer frame 43 and the inner frame 45. In addition, as can be seen in FIG. 4, the width of the blade 44 at its proximal end is less than the width of the inner frame 45. Furthermore, the length between the ends of the blade 44 is greater than the length between the ends of the inner frame 45. By means of these arrangements, the blade 44 presents bending stiffness that is less than that of the inner frame 45, and more generally less than that of the remainder of the catch 40. The blade 44 can thus be subjected to bending in particular in the main plane of the catch 40, and it acts like a spring blade.

The protuberance 24 has an inclined surface 24*a*. Furthermore, the blade 44 has an inclined surface 44*a*, at its distal end in this example. As can be seen by comparing the locked (left) and unlocked (right) positions in FIG. 4, retracting a blade 44 in order to unlock the support causes the blade 44 to be subjected to bending as a result of co-operation between the inclined surfaces 44*a* and 24*a* respectively of the blade 44 and of the protuberance 24 of the base 20. More precisely, the blade 44 is in the rest position when the catch 40 is in the locked position. When the catch 40 is turned towards the unlocked position, the inclined surface 24*a* of the protuberance 24 exerts a force on the surface 44*a* of the blade 44, thereby bending the blade 44 and retracting the blade 44 away from to its locked position. In order to ensure that the blade 44 does not impede passage through the slot 22, its end is provided with a surface 44*b* extending the surface 44*a* and inclined relative thereto.

Insofar as the blade 44 is being subjected to bending while the catch 40 is in the unlocked position, forces are exerted between the inclined surface 24*a* of the protuberance 24 and the inclined surface 44*a* of the blade 44. If the catch 40 is not held in the unlocked position, these forces tend to return the catch 40 into the locked position. Thus, the blade 44 forms return means configured to return the catch 40 from the unlocked position to the locked position. Consequently, the passage from the unlocked position to the locked position can take place simply as a result of this return force, without using any drive mechanism.

As mentioned above, each catch 40 is actuated by a distinct drive mechanism 50, in particular for passing from the locked position to the unlocked position.

In this embodiment, in order to be driven, the catch 40 has at least one cam surface 41. In addition, the catch 40 has at least one abutment 42. In this example, the catch 40 has two cam surfaces 41 and two abutments 42. This makes the catch 40 symmetrical and makes it easier to fabricate. Nevertheless, only one cam surface and only one abutment are described below. The shapes of the cam surface 41 and of the abutment 42 are configured to co-operate with the cam 52. In this embodiment, the cam 52 presents the general shape of a lowercase letter b, or of a comma, having an off-center projecting straight portion 52*a* and a round portion 52*b*.

In the locked position (left portion of FIG. 4), the cam 52 does not co-operate with the catch 40. The off-center projecting portion 52*a* is spaced apart from the catch 40. On passing to the unlocked position, the cam 52 turns, in this example clockwise in FIG. 4. The off-center projecting portion 52*a* comes closer to the cam surface 41 and then engages the abutment 42, thereby driving turning of the catch 40, in this example in the counterclockwise direction. After half a revolution, the resulting position is that shown on the right in FIG. 4. This is an unlocked position.

With the cam 52 continuing to turn from the unlocked position, the off-center projecting portion 52*a* slides along the abutment 42 until it loses contact with said abutment. Since the round portion 52*b* is far away from the catch 40, there is no longer any contact between the cam 52 and the catch 40, and this continues at least until the cam 52 returns to its starting position (on the left in FIG. 4). Under such conditions, the only forces acting on the catch 40 are the bending forces of the blade 44, which return the catch 40 to the locked position, as explained above.

Furthermore, the drive mechanism 50 has detector means for detecting an unlocked position of the catch 40. These detector means are constituted in this example by a switch 54. The switch 54 is secured to the base 20 (specifically being carried by the drive mechanism 50, itself fastened to the base) in such a manner as to be suitable for co-operating with a presser portion 47 of the catch 40. As shown in the left and right portions of FIG. 4, turning the catch changes the distance between the presser portion 47 and the switch 54, such that the switch is activated by the presser portion 47 when the catch is in the unlocked position. The signal sent by the switch 54 may be used in co-operation with electronic control means to stop the movement of the cam 52, e.g. in order to hold the catch 40 in the unlocked position for a predetermined duration. The electronic control means then form timer means.

Figure 5:
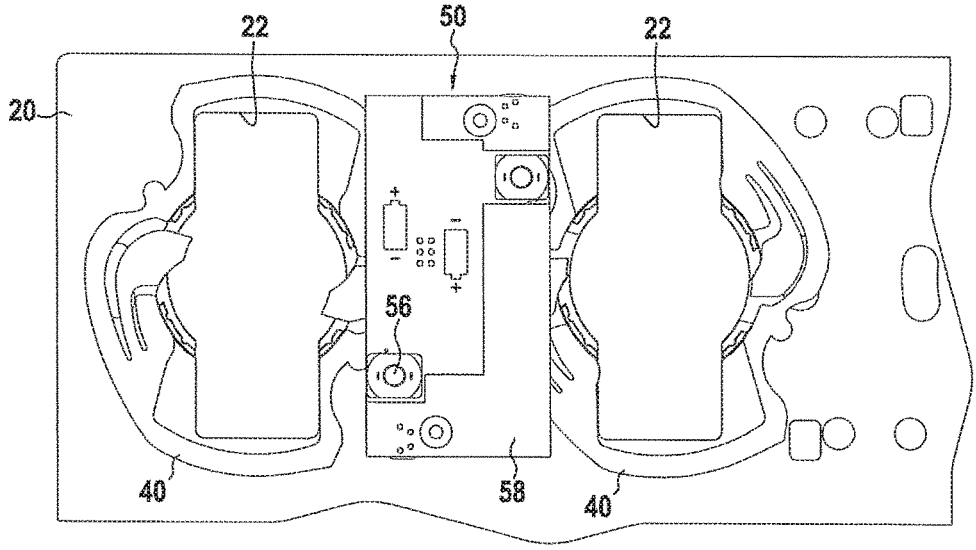
FIG. 5 is a rear view of the article presentation device showing the entire drive mechanism.

The drive mechanism 50 is described in detail below with reference to FIG. 5. In FIG. 5, as in FIG. 4, the catch 40 on the left is shown in the locked position while the catch 40 on the right is shown in the unlocked position.

In addition to the above-described cam 52 and switch 54, the drive mechanism 50 comprises a motor 56 and an electronic control circuit 58. FIG. 5 shows two drive mechanisms 50, one for each catch 40. The two electronic control circuits are arranged on a common electronic card, but they are entirely independent. In addition, each drive mechanism has its own motor 56. Thus, each catch 40 is actuated by a distinct drive mechanism 50.

The motor 56 may be of any conventional type and it is not described herein. The motor 56 drives the cam 52 in rotation. The electronic control circuit 58 controls the motor 56. For example, the drive mechanism 50 may be configured by means of the electronic control circuit 58 to receive authorization to unlock, and on receiving said authorization, to activate the motor 56 so as to drive the catch 40 from the locked position to the unlocked position. For this purpose, the electronic control circuit 58 may have a wired or wireless receiver, e.g. of the infrared type, for receiving authorization to unlock.

Furthermore, the electronic control circuit 58 may be configured, as described above, to take account of the position of the catch 40 as detected by the switch 54.

There follows a description of an example use of the device 10. The catch 40 is initially in its locked position. The drive mechanism 50 receives from the electronic control circuit 58 authorization to unlock, e.g. by means of a signal sent by a salesperson's infrared remote control. On receiving this authorization, the electronic control circuit 58 activates the motor 56, which drives rotation of the cam 52. The cam 52 itself drives turning of the catch 40 starting from the locked position.

The catch 40 can turn until its presser portion 47 activates the switch 54. The catch 40 is then in its unlocked position. Activation of the switch 54 is detected by the electronic control circuit 58, which stops rotation of the motor 56 for a predetermined duration, e.g. a few seconds. During this duration, the salesperson can withdraw the support 30 from the slot 22. At the end of this duration, regardless of whether or not the support 30 has been put back in the slot 22, the electronic control circuit 58 causes the motor 56 to rotate once more. The motor 56 drives rotation of the cam 52, which loses contact with the catch 40. The catch 40 thus returns to the locked position as explained above, while the cam 52 continues its revolution. The motor 56 may be stopped when the cam 52 has returned to its original position. By limiting the time during which the catch 40 is in the unlocked position and the blades 44 are in bending, premature wear of the blades 44 is avoided, and in particular premature wear of their attachment arms 44' that impart the spring effect thereto.

Figure 6:
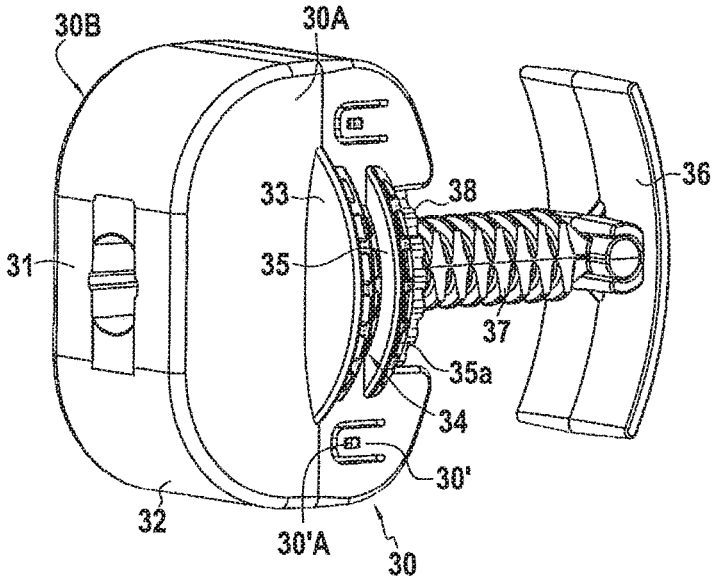
FIG. 6 is a perspective view of an embodiment of a watch support.

FIG. 6 is a perspective view of a support 30 of the device 10. The support 30 is particularly configured to receive a bracelet, a wristwatch, or any analogous article. The support 30 has a main body 32 with a front collar 33 and a rear collar 35 as described above with reference to FIG. 1. Between them, the collars 33 and 35 define a locking groove 34 suitable for co-operating with the blade 44 of the catch 40 in order to act in the locked position to hold the support 30 in the slot 22.

In order to accommodate bracelets or watch straps of different diameters, the support 30 includes a back rest 36 that is connected to the main body 32 by a screw 37. A threaded ring 38 serves to engage the screw 37 to a greater or lesser extent in the main body 32, so as to move the back rest 36 closer to or further away from the main body 32. In this way, when a bracelet or a wristwatch is positioned around the support, e.g. with the dial of the watch resting on the front face 31 of the main body 32, the ring 38 can be turned so that the bracelet or the watch strap is tensioned around the main body 32 and the back rest 36.

Furthermore, as mentioned above, the catch 40 is configured, when in the locked position, to allow the support 30 to be inserted in the slot 22. As already mentioned, in the present embodiment, the catch 40 is urged into the locked position only by the flexing of the blades 44. If a user attempts to insert a support 30 into the slot 22 in this position, the support will come up against the blades 44. Nevertheless, the blades 44 and/or the support 30 may be configured so that inserting the support 30 into the slot 22 moves the blades 44 away.

For this purpose, in the present embodiment, the rear collar 35 has beveled studs 35*a*. At their distal ends, the blades 44 may have corresponding chamfered surfaces to facilitate the action of the studs 35*a*. Thus, when the support 30 is inserted in the slot while the catch 40 is in the locked position, the longitudinal force going from front to back that is exerted by the support 30 acts via the studs 35*a* to deliver transverse forces against the blades 44, thereby moving them away. Once the rear collar 35 has passed fully behind the blades 44, the return force of the blades 44 returns the catch 40 to the locked position, with the blades 44 then engaging in the locking groove 34. In this state, the support 30 can no longer be withdrawn without unlocking the catch. Thus, the configuration of the catch 40 and of the support 30 can form a snap-fit mechanism.

The support 30 carries positioning tongues 30' that contribute to properly positioning the support in the slot 22. Specifically, these tongues bear against the edges of the slot. In particular when the catch is unlocked, this makes it possible to avoid the support having any tendency to tilt in the slot under its own weight and the weight of the product that it is carrying, in particular a watch. Specifically, the tongues 30' are made on at least of the cheeks 30A of the support (and preferably on both cheeks 30A and 30B) and they project resiliently outwards from the cheek carrying them. The resilient tongues may co-operate with the edges of the slot by snap-fitting, and for this purpose, they may carry respective projecting pips 30'A or the equivalent.

The catch 40 may be made out of any material suitable for its function, e.g. out of a plastics material or a resin, e.g. a material of the Altuchoc® type or of the polyoxymethylene (POM) type. Each of the other components may also be made of these materials. The catch 40 and the base 20 may be obtained by being cut out from plates, thereby greatly simplifying fabrication and reducing the cost of obtaining them.

The embodiment of the support 30 that is described is configured for receiving bracelets or wristwatches. Nevertheless, the support 30 could be modified to receive any other type of article for presentation, without changing the way in which it co-operates with the slot 22 and the catch 40.

Although the present invention is described with reference to specific embodiments, modifications may be made to those embodiments without going beyond the general ambit of the invention as defined by the claims. In particular, individual characteristics of various embodiments shown and/or mentioned may be combined in additional embodiments. Consequently, the description and the drawings should be considered in a sense that is illustrative rather than restrictive.

The invention claimed is:

1. An article presentation device comprising a base having at least one slot, at least one support configured to receive at least one article and to be inserted in and extracted from the at least one slot along an insertion direction, and at least one catch that is movable between a locked position in which the at least one catch is suitable for co-operating with the support in order to retain it in the at least one slot, and an unlocked position in which the at least one catch enables the support to be extracted from the at least one slot, wherein a respective one of the at least one catch is associated with a respective one of said at least one slot and being actuated by a distinct drive mechanism, wherein the drive mechanism is configured to drive the respective one of at least one catch in turning about the insertion direction.

2. An article presentation device according to claim 1, wherein the drive mechanism is configured to drive the respective one of said at least one catch in turning about an axis extending through the respective one of said at least one slot.

3. An article presentation device according to claim 1, wherein the at least one catch is generally plate-formed, optionally being made as a single piece, and the respective one of at least one catch extends substantially parallel to the respective one of said at least one slot.

4. An article presentation device according to claim 1, wherein the at least one slot includes at least one window and a portion of the at least one catch crosses said window.

5. An article presentation device according to claim 1, wherein the at least one catch in the locked position is configured to enable the support to be inserted in the at least one slot.

6. An article presentation device according to claim 1, wherein the at least one catch includes return means configured to urge the at least one catch from the unlocked position to the locked position.

7. An article presentation device according to claim 1, wherein the drive mechanism includes detector means for detecting an unlocked position of the at least one catch.

8. An article presentation device according to claim 1, wherein the support includes a locking portion configured to co-operate with the at least one catch when the at least one catch is in the locked position.

9. An article presentation device according to claim 1, wherein the drive mechanism is configured to receive authorization to unlock, and on receiving said authorization, to drive the at least one catch from the locked position to the unlocked position.

10. An article presentation device according to claim 1, wherein the support is configured to receive a watch.

11. An article presentation device according to claim 1, wherein the drive mechanism comprises a cam configured to drive the at least one catch from the locked position to the unlocked position and to leave the at least one catch free to move from the unlocked position to the locked position.

12. An article presentation device comprising a base having a slot, a support configured to receive at least one article and to be inserted in and extracted from the slot along an insertion direction, and a catch that is movable between a locked position in which the catch is suitable for co-operating with the support in order to retain it in the slot, and an unlocked position in which the catch enables the support to be extracted from the slot, wherein said catch is actuated by a drive mechanism configured to drive the catch in turning about the insertion direction, wherein the catch extends substantially parallel to the slot.

13. An article presentation device comprising a base having at least one slot, at least one support configured to receive at least one article and to be inserted in and extracted from the at least one slot, and at least one catch that is movable between a locked position in which the at least one catch is suitable for co-operating with the support in order to retain it in the at least one slot, and an unlocked position in which the at least one catch enables the support to be extracted from the at least one slot, wherein a respective one of the at least one catch is associated with a respective one of said at least one slot and being actuated by a distinct drive mechanism, wherein the drive mechanism is configured to drive the respective one of at least one catch in turning, wherein the at least one catch includes return means configured to urge the at least one catch from the unlocked position to the locked position.

* * * * *